US005787542A

United States Patent [19]

Chien

[11] Patent Number: 5,787,542

[45] Date of Patent: Aug. 4, 1998

[54] BATHING PAD ASSEMBLY

[76] Inventor: Kuo-Ching Chien, No. 7, Lane 74, Kung-Wu Road, Lung-Tan, Tao Yuan, Taiwan

[21] Appl. No.: 745,861

[22] Filed: Nov. 12, 1996

[51] Int. Cl.[6] ..... A47K 7/02

[52] U.S. Cl. ..... 15/244.3; 15/209.1; 15/227

[58] Field of Search ..... 15/208, 209.1, 15/227, 229.11, 229.12, 244.3

[56] References Cited

U.S. PATENT DOCUMENTS

| | | | |
|---|---|---|---|
| 3,252,176 | 5/1966 | Gropper | 15/209.1 |
| 4,457,640 | 7/1984 | Anderson | 15/227 |
| 5,598,596 | 2/1997 | Jones | 15/244.3 |

FOREIGN PATENT DOCUMENTS

| | | | |
|---|---|---|---|
| 526961 | 9/1956 | Belgium | 15/244.3 |
| 2634995 | 2/1990 | France | 15/244.3 |
| 122367 | 7/1901 | Germany | 15/244.3 |

*Primary Examiner*—Randall Chin
*Attorney, Agent, or Firm*—Bacon & Thomas

[57] ABSTRACT

Bathing may be conducted in a sanitary and efficient manner by utilizing a braided bag within which a bathing pad is disposed, the bag being provided with an elastic neck and mouth opening which is secured in a closed position by a binding ribbon and a fixing member.

2 Claims, 3 Drawing Sheets

BATHING PAD ASSEMBLY

BACKGROUND OF THE INVENTION

1. Field of the Invention

The present invention relates to bathing devices, and especially to a bathing pad assembly which can be disassembled for cleaning after bathing to prevent dirt or soiling substance from accumulating on the assembly or on parts forming the assembly, including a braided bag for enclosing the pad. The assembly can be disassembled so that the braided bag and the bathing pad can be cleaned after use, which ensures sanitary bathing.

2. Description of the Prior Art

The human body may occasionally be contaminated with micro-dust or fine filth, and also sweat. Therefore, cleansing after activity for a period of time by bathing to wash off the dirt and become clean again is necessary to prevent illness. Normally in bathing, various bathing articles are used to thoroughly wash off dirt and accumulated filth. Such articles include cotton cloths, sponges, luffa cloths and bathing brushes. However, cotton cloths and sponges are relatively soft, and must be forcibly applied when used in scrubbing, otherwise cleansing will not be achieved if they are applied too lightly. Materials used to make luffa cloths and bathing brushes are slightly stiff, so the body may be subjected to harm by using these articles, resulting in redness or pain. There are devices wherein cotton cloths, sponges, luffa cloths and bathing brushes may be enveloped within stiffer mesh cloths which are sealed after the articles are placed in the mesh cloths, so that the bathing articles can no longer be taken out or changed, thus fixing their sizes and shapes.

During bathing, the mesh cloths are subjected to accumulation of dirt, and when they are used for a long period, the dirt will accumulate on the bathing articles to form a foul condition. When such devices are used by a whole family, the situation will be even more serious. In this case, if they are changed frequently, increased cost will result, and if they are changed infrequently, bacteria will propagate, and infection may occur.

Known bathing articles may be advantageous, but sanitation is more important. In normal use, bathing articles generally accumulate water which causes bacteria to propagate. This causes the bathing articles to easily decay and shorten their useful life. Thorough cleaning of the body cannot be easily realized without some form of bathing article.

SUMMARY OF THE INVENTION

In view of this, the inventor of the present invention knows that cleansing of human bodies is extremely important. The inventor thereby provides the present invention based on his professional experience of years in designing, manufacturing and selling similar products. The present invention comprises a bathing pad enveloped in a braided bag, wherein the assembly can be disassembled after using for cleaning the bathing pad and ensuring bathing sanitation.

Accordingly, the principal object of the present invention is to provide a bathing pad enveloped in a braided bag, and the assembly can be disassembled after using for cleaning and thereby ensure that bathing can be more sanitary and safe.

Another object of the present invention is to provide a bathing pad enveloped in a braided bag which can be held in the palm of one hand for direct scrubbing to achieve the affect of bathing.

Another object of the present invention is to provide bathing pads enveloped in braided bags which can be hung on walls or any kind of hanging support when they are not in use, so that they do not become lost. The hanging of bathing articles after bathing ensures water removal and keep the articles dry and in good sanitary condition so that the useful life of the articles can be increased.

A further object of the present invention is to provide bathing pads enveloped in braided bags wherein the pads can be changed with other pads of any shape and size.

The present invention will be apparent in its structure, characteristics and mode of using from the detailed description of the preferred embodiments thereof with reference to the accompanying drawings.

DETAILED DESCRIPTION OF THE PREFERRED EMBODIMENT

Figure 1:
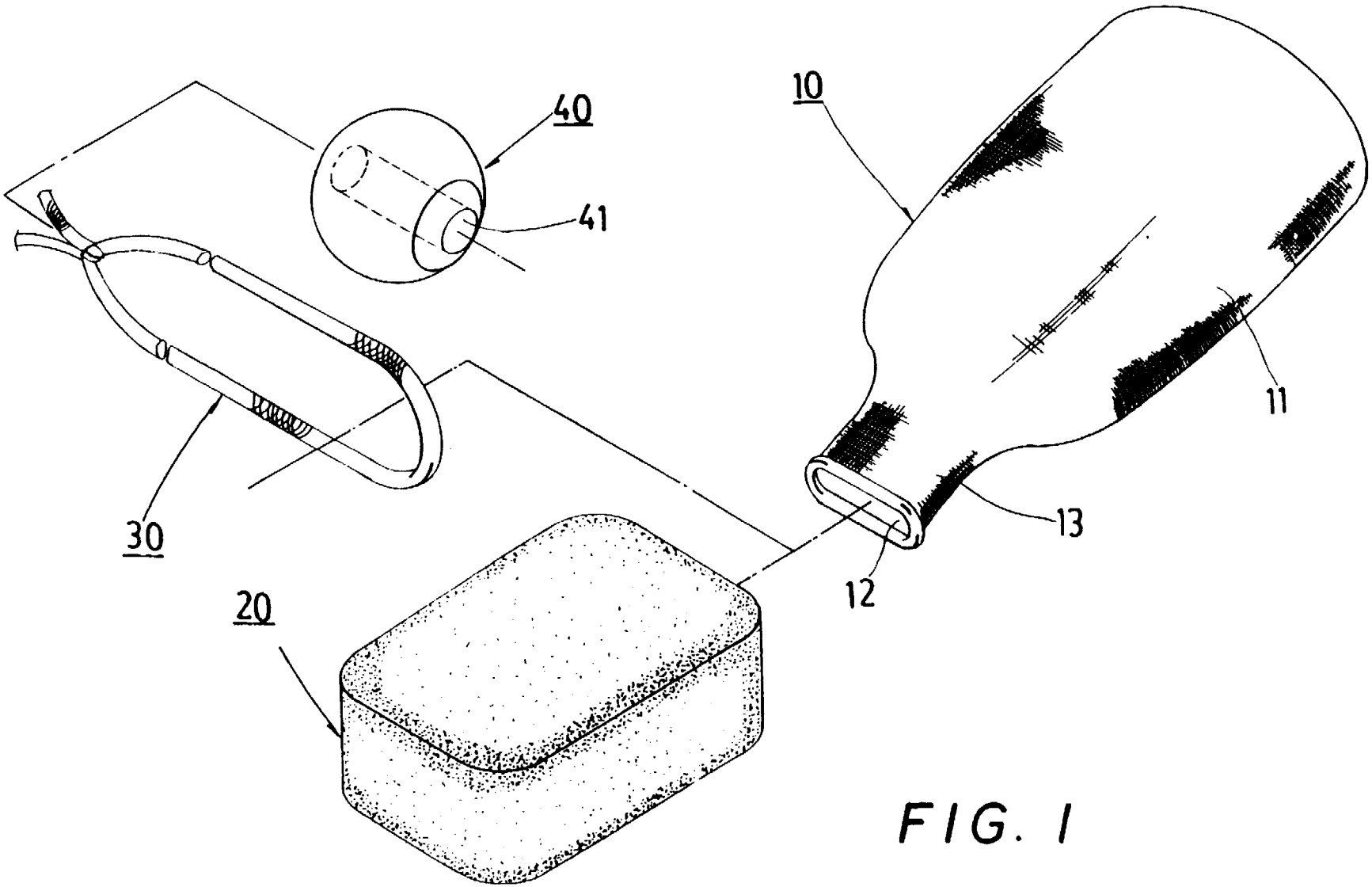
FIG. 1 is an exploded perspective view of the present invention.

Referring to FIG. 1 of the drawings, the present invention is comprised of a braided bag 10, a bathing pad 20 which is of rectangular shape in this embodiment, a binding ribbon 30 and a fixing member 40.

The braided bag 10 is a bag formed by braiding, with a body 11 which is wider than and gradually gets smaller toward a mouth 12 to form an elastic neck 13 for tightly binding the mouth 12. The bathing pad 20 is made of soft elastic material. The binding ribbon 30 is used to tightly bind the elastic neck. The fixing member 40 is provided with a round hole 41 through which the binding ribbon 30 and the mouth 12 of the elastic neck 13 may be pulled.

Figure 2:
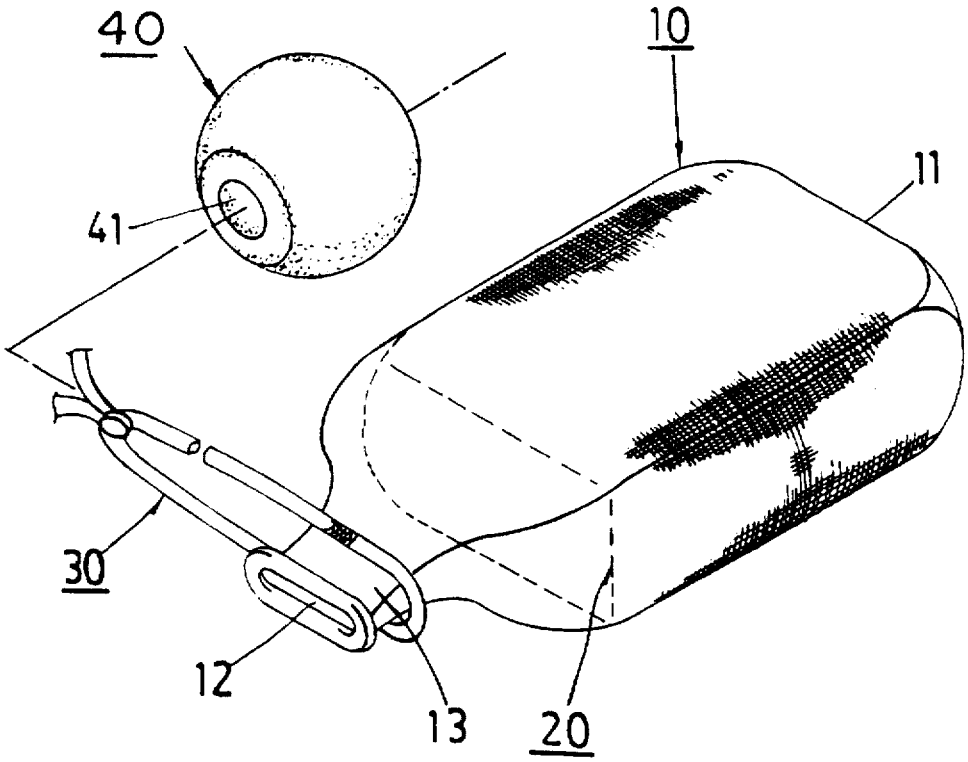
FIG. 2 is an exploded perspective view of the present invention showing its manner of assembling.
Figure 3:
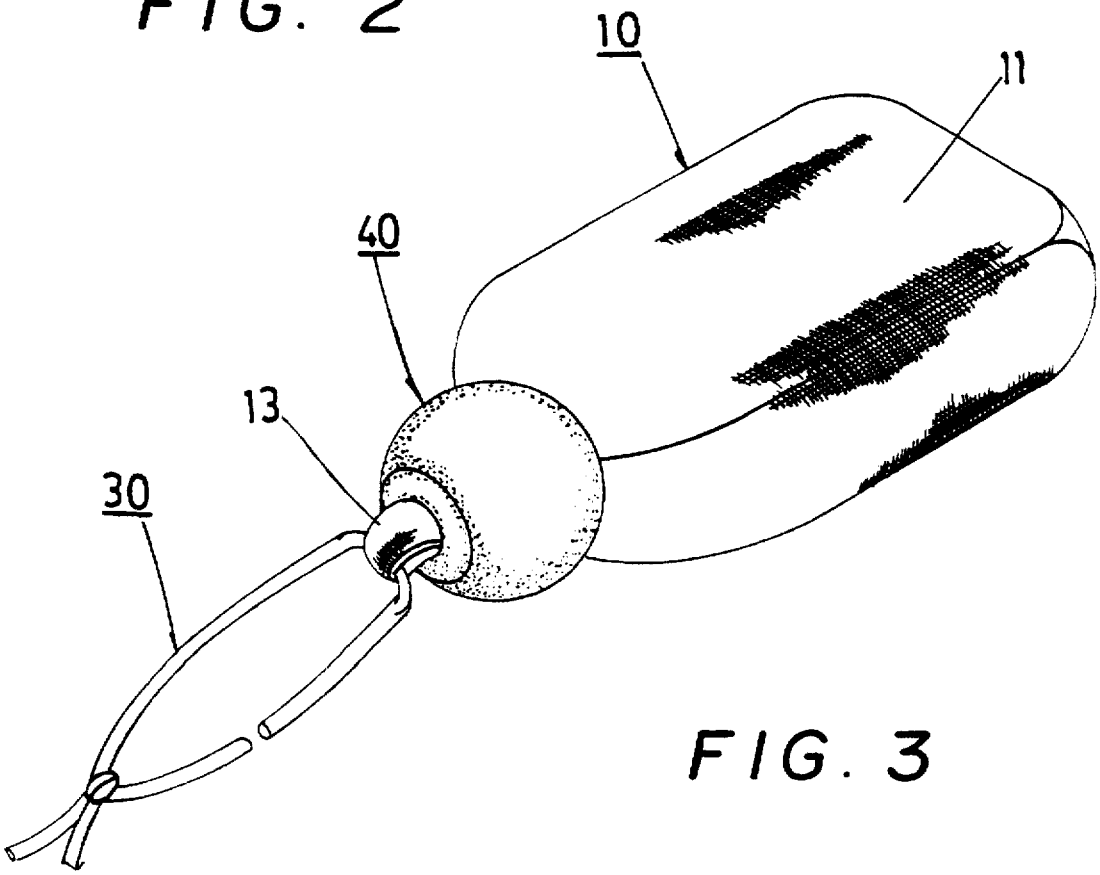
FIG. 3 is a perspective view of the present invention in assembled form.

By means of the above parts, the bathing pad 20 is first pressed through the mouth 12 of the braided bag 10 into the body 11 of the braided bag 10, so that the braided bag 10 envelops the bathing pad 20. The binding ribbon 30 is then placed around the elastic neck 13, as seen in FIG. 2. The binding ribbon 30 is pulled through the round hole 41 of the fixing member 40. The elastic neck 13 of the braided bag 10 is folded over ribbon 30 and the folded portion is drawn into the round hole 41 of the fixing member 40 by pulling ribbon 30. Thus, as shown in FIG. 3, the bathing pad 20 is completely enclosed by the braided bag 10.

When in use, the braided bag 10 directly contacts the body, so any dirt on the body will be attached to the surface of the braided bag 10. After use, the elastic neck 13 of the braided bag 10 is pulled out of the round hole 41 of the fixing member 40, the bathing pad 20 is taken out of the braided bag 10, and the braided bag 10 can be washed so that dirt will not become attached directly on the surfaces of the bathing pad 20. This maintains sanitation of the braided bag 10 and the bathing pad 20.

Figure 4:
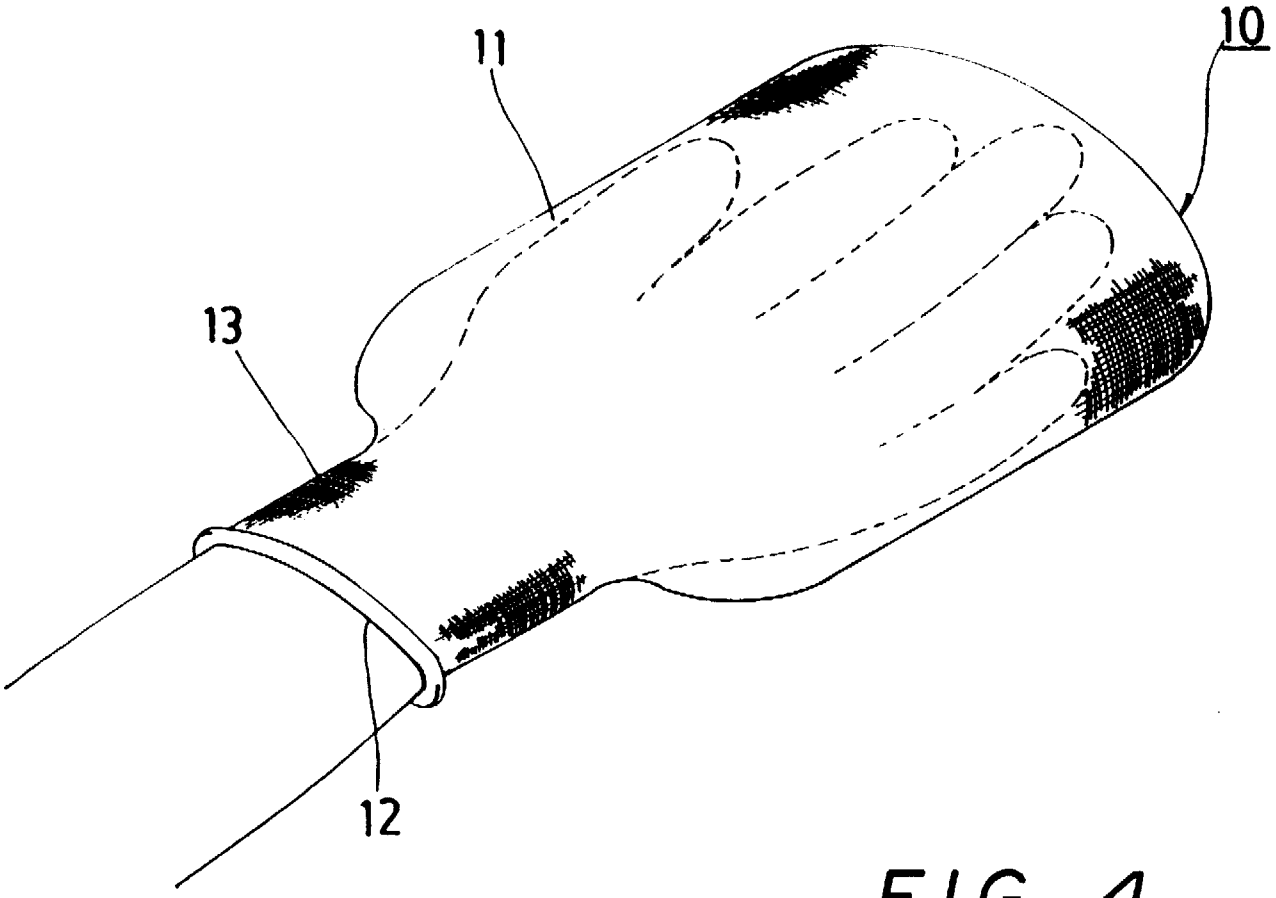
FIG. 4 is a perspective view of another embodiment of the present invention.

Referring further to FIG. 4, the braided bag 10 of the present invention can be put on a palm with the elastic neck 13 of the braided bag 10 fitting over the wrist of the user. The braided bag 10 can thus be held by a hand for direct scrubbing during bathing. The braided bag 10 can be taken off for washing after use to keep it clean.

As stated above, the present invention uses the braided bag 10 to envelop the bathing pad 20 to prevent dirt from direct contact with the bathing pad 20, and only allow dirt to contact with the surface of the braided bag 10. The braided bag 10 can be washed after use, so that the braided bag 10 and the bathing pad 20 can be kept clean. The braided bag 10 can also be put on a palm to provide sanitary use.

Having thus described the structure of my invention, what I claim is:

1. A bathing pad assembly comprising:

a) a braided bag formed of soft elastic material and including a body portion which gradually reduces in size to terminate in an open mouth, and an elastic neck being positioned between the mouth and the body for closing off the mouth;

b) a bathing pad passed through the mouth and disposed within the bag, with the bag enveloping the pad;

c) a binding ribbon having a portion thereof securable around the neck;

d) a fixing member having a hole through which the binding ribbon and neck may be pulled; and e) wherein when the binding ribbon is secured around the neck and also drawn through the hole of the fixing member, the neck may be folded over the binding ribbon and also drawn through the hole of the fixing member in its folded position by pulling the binding ribbon, thereby tightly closing the mouth.

2. The bathing pad assembly of claim 1 wherein the braided bag is of sufficient size and shape for enveloping the hand of a user which is inserted into the bag through the mouth thereof.

* * * * *